US011060783B2

(12) United States Patent
Ros

(10) Patent No.: US 11,060,783 B2
(45) Date of Patent: Jul. 13, 2021

(54) TRANSPORT CONTAINER FOR TRANSPORTING TEMPERATURE-SENSITIVE TRANSPORT GOODS

(71) Applicant: REP IP AG, Zug (CH)

(72) Inventor: Nico Ros, Riehen (CH)

(73) Assignee: REP IP AG, Zug (CH)

( * ) Notice: Subject to any disclaimer, the term of this patent is extended or adjusted under 35 U.S.C. 154(b) by 42 days.

(21) Appl. No.: 15/224,249

(22) Filed: Jul. 29, 2016

(65) Prior Publication Data

US 2017/0038116 A1 Feb. 9, 2017

(30) Foreign Application Priority Data

Aug. 4, 2015 (AT) ..... A 518/2015

(51) Int. Cl.
*F25D 11/00* (2006.01)
*F25D 3/08* (2006.01)
(Continued)

(52) U.S. Cl.
CPC ..... *F25D 3/08* (2013.01); *F25B 21/04* (2013.01); *F25D 11/006* (2013.01);
(Continued)

(58) Field of Classification Search
CPC ..... F25B 21/04; F25B 2321/023; F25D 3/08; F25D 11/003; F25D 23/06;
(Continued)

(56) References Cited

U.S. PATENT DOCUMENTS 4,091,863 A * 5/1978 Schroder ..... C09K 5/063 126/400
4,461,153 A * 7/1984 Lindner ..... C09K 5/063 62/3.2
(Continued)

FOREIGN PATENT DOCUMENTS

CN 102200366 A 9/2011
DE 1126426 B 3/1962
(Continued)

OTHER PUBLICATIONS

Search Report dated Feb. 29, 2016, in corresponding Austrian Application No. 518/2015 (1 Page).
(Continued)

*Primary Examiner* — David J Teitelbaum
(74) *Attorney, Agent, or Firm* — Fitch, Even, Tabin & Flannery, LLP

(57) ABSTRACT

A transport container for transporting temperature-sensitive transport goods includes an interior for receiving the transport goods and an enclosure enclosing the interior and provided with a heat insulation, wherein at least one latent heat accumulator and at least one active temperature-control element are provided for controlling the temperature in the interior. The enclosure is preferably a multilayer enclosure, wherein a heat insulation, a latent heat accumulator, and optionally an active temperature-control element, are configured as mutually separate, superimposed layers of the enclosure.

19 Claims, 1 Drawing Sheet

(51) Int. Cl.
*F25B 21/04* (2006.01)
*F25D 23/06* (2006.01)
*B65D 81/38* (2006.01)

(52) U.S. Cl.
CPC .... *B65D 81/3816* (2013.01); *F25B 2321/023* (2013.01); *F25D 23/06* (2013.01); *F25D 2303/0843* (2013.01); *F25D 2303/0844* (2013.01); *F25D 2303/08221* (2013.01); *F25D 2331/80* (2013.01)

(58) Field of Classification Search
CPC ... F25D 2303/08221; F25D 2303/0843; F25D 2303/0844; F25D 2331/80; F25D 11/006; B65D 81/3816
USPC ..... 62/438, 434
See application file for complete search history.

(56) References Cited

U.S. PATENT DOCUMENTS

| | | | | |
|---|---|---|---|---|
| 5,388,423 | A * | 2/1995 | Khelifa | B60H 1/00007 237/12.3 A |
| 6,092,381 | A * | 7/2000 | Hsiao | F25D 16/00 62/237 |
| 6,666,032 | B1 | 12/2003 | Rickson et al. | |
| 7,082,773 | B2 | 8/2006 | Cauchy | |
| 8,726,688 | B2 * | 5/2014 | Ghiraldi | F25D 11/006 62/438 |
| 8,763,423 | B2 * | 7/2014 | Tattam | B65D 88/14 62/457.1 |
| 10,610,451 | B2 | 4/2020 | Gray | |
| 2004/0226309 | A1 | 11/2004 | Broussard | |
| 2006/0248902 | A1 * | 11/2006 | Hunnell | F25B 21/02 62/3.6 |
| 2008/0099492 | A1 * | 5/2008 | Mayer | B65D 81/3816 220/592.2 |
| 2009/0078708 | A1 | 3/2009 | Williams | |
| 2010/0024439 | A1 * | 2/2010 | Finke | A47F 3/0482 62/3.6 |
| 2010/0170286 | A1 * | 7/2010 | Ghiraldi | F25D 11/006 62/434 |
| 2011/0079140 | A1 * | 4/2011 | Baseley | F15B 1/26 92/90 |
| 2011/0099814 | A1 * | 5/2011 | Fuerst | A45D 27/46 30/34.05 |
| 2011/0247356 | A1 * | 10/2011 | Krosse | F25B 21/02 62/457.1 |
| 2012/0072046 | A1 * | 3/2012 | Tattam | B65D 88/14 700/300 |
| 2012/0148886 | A1 * | 6/2012 | Krause | H01M 10/625 429/72 |
| 2014/0033759 | A1 | 2/2014 | Ide et al. | |
| 2014/0054297 | A1 * | 2/2014 | Patstone | F25D 3/08 220/592.01 |
| 2015/0166262 | A1 | 6/2015 | Farrar | |
| 2015/0330697 | A1 | 11/2015 | Tanaka et al. | |
| 2018/0266746 | A1 | 9/2018 | Urayama et al. | |

FOREIGN PATENT DOCUMENTS

| | | | | |
|---|---|---|---|---|
| DE | 4142843 | A1 | 4/1993 | |
| DE | 202006010757 | U1 | 11/2006 | |
| GB | 1569134 | A | 6/1980 | |
| JP | H05264153 | A | 10/1993 | |
| JP | H07253264 | A | 10/1995 | |
| JP | 2004156839 | A | 6/2004 | |
| JP | 2004317041 | A | 11/2004 | |
| WO | WO-9811397 | A1 * | 3/1998 | B60H 1/00478 |
| WO | 2000021830 | A1 | 4/2000 | |
| WO | 2002037195 | A2 | 5/2002 | |
| WO | 2004/080845 | A1 | 9/2004 | |
| WO | 2015055836 | A1 | 4/2015 | |

OTHER PUBLICATIONS

Office Action issued against EP Patent Application No. 16450011.8 dated Sep. 21, 2020 in German (7 pages).

* cited by examiner

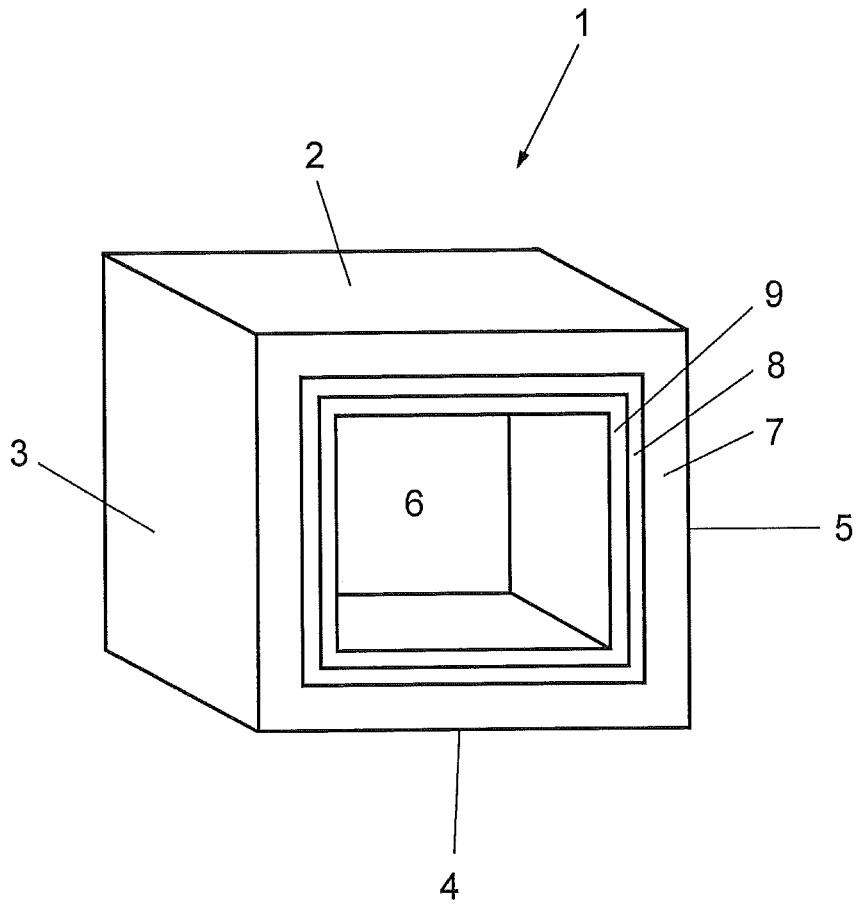
1
2
9
8
7
3
6
5
4

TRANSPORT CONTAINER FOR TRANSPORTING TEMPERATURE-SENSITIVE TRANSPORT GOODS

CROSS-REFERENCE TO RELATED APPLICATIONS

This application claims priority from Austrian Patent Application No. A 518/2015, filed Aug. 4, 2015 which is hereby incorporated herein by reference in its entirety for all purposes.

FIELD

The transport container for transporting temperature-sensitive transport goods, comprises an interior for receiving the transport goods and an enclosure enclosing the interior and comprising a heat insulation, wherein at least one latent heat accumulator and at least one active temperature-control element are provided for controlling the temperature in the interior.

BACKGROUND

When transporting temperature-sensitive transport goods, such as e.g. pharmaceuticals, over periods of several hours or days, predefined temperature ranges will have to be maintained during storage and transport in order to safeguard the usability and safety of the pharmaceuticals. Temperature ranges from 2 to 25° C., in particular 2 to 8°, are defined for different pharmaceuticals.

The desired temperature range can be above or below ambient temperature, thus requiring either cooling or heating of the interior of the transport container. If the ambient conditions change during a transport procedure, the required temperature control may comprise both cooling and heating. In order that the desired temperature range will be permanently and verifiably maintained, transport containers with special insulation capacities are used. Such containers are equipped with passive or active temperature-control elements. Passive temperature-control elements do not require external energy supply during application, but rather use their heat storing capacity, involving, as a function of the temperature level, the release or absorption of heat to and respectively from the interior of the transport container to be temperature-controlled. Such passive temperature-control elements are, however, depleted once the temperature equalization with the interior of the transport container has been completed.

A special type of passive temperature-control elements are latent heat accumulators, which are able to store thermal energy in phase-change materials, whose latent heat of fusion, heat of solution or heat of absorption is substantially higher than the heat they are able to store on account of their normal specific heat capacity. Latent heat accumulators involve the drawback of loosing their effect once all of the material has experienced a complete phase change. However, the latent heat accumulator can be recharged by carrying out an inverse phase change.

Active temperature-control elements require an external energy supply for their operation. They are based on the conversion of a non-thermal type of energy into a thermal type of energy. The release or absorption of heat in this case, for instance, takes place in the context of a thermodynamic cycle process, e.g. by using a compression refrigerating machine. Another active temperature-control element configuration operates based on the thermoelectric principle by using so-called Peltier elements.

Transport containers in which active and passive temperature-control elements are combined in such a manner that the active temperature-control elements are used for recharging the latent heat accumulators, if necessary, are already known. US 2015/166262 A1 describes a transport container comprising latent heat accumulators arranged in a container region separated from the space receiving the transport goods and acting as both cooling elements and heating elements. A blower produces an air circulation by which air is optionally conducted over the surfaces of the latent heat accumulators acting as cooling elements, or over the surfaces of the latent heat accumulators acting as heating elements, and the thus controlled air is conveyed into the receiving space for the transport goods. In the latent heat accumulator elements extend ducts through which actively cooled or heated medium can flow for recharging the latent heat accumulators. The ducts are part of a compression refrigerating machine, whose components may be arranged in a separate region of the transport container.

In the subject matter of US 2004/226309 A1, air cooled by heat exchange with a compression refrigerating machine is conducted into the receiving space for the transport goods to cool the transport goods there. The cooled air can also be blown over surfaces of a latent heat accumulator to recharge the latter so as to ensure temperature control of the transport goods even after the active temperature control system has been shut down.

WO 2004/080845 A1 likewise describes a transport container with active and passive temperature-control elements. The main cooling is achieved by a compression refrigerating machine. A latent heat accumulator that can be charged by heat exchange with the compression refrigerating machine is provided as a backup system. In the passive backup operation, air is blown over surfaces of the latent heat accumulator to temperature-control the transport goods by the thus controlled air.

The described systems involve the drawbacks, including having the active and/or passive temperature-control elements are disposed in a special, usually separated region of the container such that an air circulation has to be produced to cause the transfer of heat between the receiving space for the transport goods and the temperature-control elements. Power-consuming blowers are necessary for producing the required air circulation, appropriate storage capacities thus having to be provided and carried along.

Furthermore, it has to be taken into account that the input of energy into the transport container is heterogeneous during transport. If the container is exposed to heat radiation, the energy input in the region of exposure is clearly higher than in regions where the container is not exposed to radiation. Nevertheless, the temperature in the interior of the container must be kept constant and homogeneous within an admissible range. An inhomogeneous energy input would involve the problem of the latent heat accumulator being not homogeneously depleted. Thus, local temperature changes would occur in the interior of the transport container after some time. If the local temperature changes exceed, or fall below, a defined threshold value, the transport goods will no longer be protected.

SUMMARY

A present transport container is provided with the aim to overcome the above-identified drawbacks. The transport container provides advantageous improvements regarding reducing power consumption, while providing a compact and simple structure, and while reducing the susceptibility to failure. In addition, local temperature differences in the interior of the transport container can be largely avoided.

To solve this object, a transport container of the initially defined kind essentially provides that the enclosure is designed as a multilayer enclosure, wherein the heat insulation, the latent heat accumulator, and optionally the active temperature-control element, are configured as mutually separate, superimposed layers of the enclosure. The layered structure allows for the latent heat accumulator and the active temperature control means to be directly integrated in the wall elements defining the interior, wherein the individual layers are in contact with the interior through heat conduction in order to control the temperature of the interior and of the transport goods contained therein. Hence, a heat transfer by convection, i.e. by the active circulation of air, is thus not required such that blowers and the like necessary therefor can be set aside. Power consumption and the susceptibility to failure will thus be reduced. Moreover, a separate container region for arranging refrigerating units and the like can be renounced.

The integration of the latent heat accumulator and the active temperature-control element in layers of the walls defining the interior, moreover, facilitates the construction of the container. The multilayer walls can be provided as prefabricated modules so as to enable the modular assembly of transport containers.

Another advantage of a configuration according to an aspect of the transportation container resides in the uniform heat input into the interior and in the large surface area available for the transfer of heat. A preferred embodiment in this respect contemplates that the latent heat accumulator layer, the insulation layer, and optionally the active temperature-control layer, each enclose the interior completely. The layer provided with the active temperature-control element, i.e. the temperature-control layer, can be used for charging the latent heat accumulator layer, if required. Alternatively or additionally, the latent heat accumulator layer can also be used to directly control the interior of the container in terms of temperature. The active temperature-control element can also be integrated in the latent heat accumulator layer. The temperature-control element may, for instance, comprise cooling or heating coils extending in the latent heat accumulator layer.

In the context of the transportation container, the three layers, i.e. the insulation layer, the latent heat accumulator layer, and optionally the active temperature-control layer, need not necessarily be arranged immediately one above the other, i.e. directly superimposed. It is also possible to connect two layers each via an interposed further layer. A further layer may be an adhesive layer that serves to interconnect the two layers or a functional layer.

Moreover, the transportation container is not limited to the enclosure having a layered structure comprising just a single latent heat accumulator layer, insulation layer and active temperature-control layer. Rather, other configurations of a transport container are feasible, and include, by way of example, a transportation container in which two or more latent heat accumulator layers, two or more insulation layers and/or two or more active temperature-control layers are provided.

A preferred embodiment provides that at least two of the three layers (latent heat accumulator layer, an insulation layer, temperature-control layer), in particular all of the three superimposed layers, are in heat-conducting connection, with one another. In a particular aspect, the heat-conducting connection comprises full-surface contact amongst two or more of the layers.

In a particularly simple manner, the transport container comprises a rectangular parallelepiped and the enclosure comprises of six walls, each of which walls is designed with at least three layers, comprising a latent heat accumulator layer, an insulation layer and an active temperature-control layer. One of the six walls can be designed as a door.

The transport container can be constructed to have structural configuration in the form of a standard-sized ISO container (20 or 40 feet) or as an airfreight container, in particular a standard unit load device, in which the transport container walls, i.e., the outer walls of the container, comprise the described layered structure.

The active temperature-control layer is preferably a layer for converting electric energy into heat to be released or absorbed. For the purpose of feeding the required electric energy, the transport container, on its outer side, is preferably equipped with connection means, in particular an electric socket, for electrically connecting an external power source. Once an external power source is available, the active temperature-control layer can thus be taken into operation.

It may, moreover, be provided that the transport container comprises an electric energy storage means such as an accumulator, which can be fed from an external power source. The electric energy accumulator can be arranged to supply the control and, optionally, temperature monitoring electronics of the transport container with electric energy. Furthermore, the electric energy accumulator can be connected to the active temperature-control layer in order to feed electric energy to the latter, if required. This enables an at least short-term operation of the active temperature-control layer even during transport, when no external power source is available.

A preferred configuration provides that the active temperature-control layer comprises Peltier elements, a heat exchanger cooperating with a thermodynamic cycle process, in particular with a compression refrigerating machine, or magnetic cooling. In a particularly preferred manner, Peltier elements are used, because these can be small-structured and easily integrated in the temperature-control layer. The temperature-control layer preferably comprises a plurality of Peltier elements, whose cold and hot sides are each connected to a common plate-shaped heat-conducting element. The plate-shaped heat-conducting elements thus constitute the upper and lower sides of the temperature-control layer, carrying Peltier elements disposed therebetween.

In the context of a present transport container, various arrangements of the individual layers are possible. By way of example, according to one of the variants, the insulation layer can be disposed between the further outwardly disposed temperature-control layer and the further inwardly disposed latent heat accumulator layer. This type of construction with an externally arranged temperature-control layer offers special advantages if the active temperature-control layer comprises Peltier elements, since the latter require a high external energy output.

Alternatively, the insulation layer is disposed further outwards than the temperature-control layer and the latent heat accumulator layer. The temperature-control layer and the latent heat accumulator layer will thus be effectively protected from external heat input.

Another variant in this context provides that the temperature-control layer is disposed between the external insulation layer and the latent heat accumulator layer. Such a disposition of the layers has the effect that the innermost disposed latent heat accumulator layer additionally homogenizes the temperature in the interior. This will, in particular, be advantageous in the configuration of the active temperature-control layer with mechanically supplied energy, e.g. by using a compression refrigerating machine.

A further variant provides that the latent heat accumulator layer is disposed between the external insulation layer and the temperature-control layer. This configuration is particularly suitable in a configuration of the active temperature-control layer with mechanically supplied energy, e.g. by using a compression refrigerating machine, or with magnetic cooling if the interior of the transport container has to be rapidly cooled in an active manner, since no delay will be caused by the latent heat accumulator layer.

As an additional measure to avoid the negative effects of energy heterogeneously acting from outside, an energy distribution layer made of a highly heat-conductive material can, moreover, be arranged within the energy distribution layer for uniformly distributing thermal energy acting on the container from outside, said energy distribution layer being preferably disposed further outside than the latent heat accumulator layer. The energy distribution layer preferably has a thermal conductivity of A>100 W/(m·K), preferably A>200 W/(m·K).

In order to achieve a homogenization of the temperature prevailing in the interior of the transport container, an energy distribution layer may be alternatively or additionally arranged on the side of the latent heat accumulator layer facing the interior. The energy distribution layer preferably has a thermal conductivity of A>100 W/(m·K), preferably A>200 W/(m·K).

In order to promote in the interior as uniform an energy distribution as possible, the innermost layer of the container wall is preferably provided with a high emissivity and/or a high conductivity. In terms of conductivity, the innermost layer can be designed as an energy distribution layer as mentioned above (thermal conductivity A>100 W/(m·K), preferably A>200 W/(m·K)). The innermost layer is the layer that is in direct contact with, or defines, the interior. In order to ensure the removal of energy from, and/or the supply of energy into, the interior to a sufficient extent such that, for instance, transport goods loaded too hot can be cooled down without convection or the entire interior can be utilized for the transport goods, the nature of the innermost layer is decisive. The latter can be treated to increase thermal radiation, the achievement of an emissivity of >0.1, preferably between 0.5 and 1, being preferred. An increase in the emissivity can be obtained by surface treatment, e.g. by incipient grinding or lacquering metals, by chromating aluminum. Alternatively or additionally, the heat transfer between the innermost layer and the transport goods, or the internal air, can be increased by enlarging the surface by structures such as undulations having radii of at least 5 mm, an enlargement of the surface by at least 30% being ideal.

The latent heat accumulator layer is preferably designed as a flat chemical latent heat accumulator, conventional configurations for the medium forming the latent heat accumulator being usable. Preferred media for the latent heat accumulator comprise paraffins and salt mixtures. The phase transition of the medium preferably ranges from 0-10° C. or between 2-25° C. in terms of temperature.

The insulation layer is preferably designed as a vacuum insulation. The insulation layer in this case preferably comprises at least one hollow space that is evacuated. Alternatively, the at least one hollow space can be filled with a gas of low thermal conductivity. Furthermore, the insulation layer may comprise a honeycomb-like structure. An advantageous configuration will result if the insulation layer comprises a plurality of, in particular, honeycombed hollow chambers, a honeycomb structure according to WO 2011/032299 A1 being particularly advantageous.

BRIEF DESCRIPTION OF THE DRAWINGS

In the following, the invention will be explained in more detail by way of an exemplary embodiment schematically illustrated in the drawing.

FIG. 1 depicts a parallelepiped-shaped transport container.

DETAILED DESCRIPTION

A transport container for transporting temperature-sensitive transport goods, comprises an interior for receiving the transport goods and an enclosure enclosing the interior and comprising a heat insulation, wherein at least one latent heat accumulator and at least one active temperature-control element are provided for controlling the temperature in the interior, characterized in that the enclosure is designed as a multilayer enclosure, wherein the heat insulation, the latent heat accumulator, and optionally the active temperature-control element, are configured as mutually separate, superimposed layers of the enclosure.

A transport container can include at least two, in particular all three, layers superimposed in heat-conducting connection with one another. In particular, with respect to at least two of the superimposed layers, in heat-conducting connection comprises full-surface contact as between such at least two of the superimposed layers.

In a transport container, the latent heat accumulator layer (9), the insulation layer (8), and optionally the active temperature-control layer (7), can each enclose the interior completely.

A transport container can comprise a polygonally shaped structure, such as a parallelepiped. For instance, transport container can comprise a rectangular parallelepiped structure in which the enclosure comprises six walls. Each of which walls can be designed with multiple layers, e.g., at least three layers comprising a latent heat accumulator layer, an insulation layer and an active temperature-control layer.

A transport container can include an access door. A wall can be designed as door. For example, with a parallelepiped structure, one of the six walls can be designed as a door.

A transport container can include an active temperature-control layer configured for converting electric energy into heat to be released or absorbed.

A transport container can include an active temperature-control layer comprising Peltier elements, a heat exchanger cooperating with a thermodynamic cycle process, in particular a compression refrigerating machine, or magnetic cooling.

A transport container can include the insulation layer disposed between the further outwardly disposed temperature-control layer and the further inwardly disposed latent heat accumulator layer.

A transport container can include a insulation layer disposed further outwards than the temperature-control layer and the latent heat accumulator layer.

A transport container can include a temperature-control layer disposed between the external insulation layer and the latent heat accumulator layer.

A transport container can include a latent heat accumulator layer disposed between the external insulation layer and the temperature-control layer.

A transport container can include an energy distribution layer comprising a highly heat-conductive material arranged within the energy distribution layer for uniformly distributing thermal energy acting on the container from outside. The energy distribution layer is preferably disposed further outside than the latent heat accumulator layer.

A transport container can include a further energy distribution layer. For example, one energy distribution layer can be disposed on either side of the latent heat accumulator layer.

FIG. 1 depicts a parallelepiped-shaped transport container 1 whose walls are denoted by 2, 3, 4, 5 and 6. On the sixth side, the transport container 1 is shown open to visualize the layered structure of the walls. The open side can, for instance, be closed by a door having the same layered structure as the walls 2, 3, 4, 5 and 6. All of the six walls of the transport container 1 have identical layered structures. The layered structure comprises an outer layer 7, an intermediate layer 8, and an inner layer 9.

According to a first variant, layer 7 is an active temperature-control element, e.g. a layer provided with Peltier elements, layer 8 is an insulation layer, and layer 9 constitutes a latent heat accumulator layer.

According to a second variant, layer 7 is an insulation layer, layer 8 is an active temperature-control element, and layer 9 is a latent heat accumulator layer.

According to a third variant, layer 7 is an insulation layer, layer 8 is a latent heat accumulator layer, and layer 9 is an active temperature-control element.

The invention claimed is:

1. A transport container for transporting temperature-sensitive transport goods, comprising an interior for receiving the transport goods and an enclosure enclosing the interior and comprising a heat insulation layer, wherein at least one latent heat accumulator layer and at least one active temperature-control Peltier layer are provided for controlling the temperature in the interior, wherein the enclosure comprises a multilayer structure comprising the heat insulation layer, the latent heat accumulator layer, and the active temperature-control Peltier layer, which are configured as mutually separate, superimposed layers, of the multilayer structure, wherein the heat insulation layer is disposed between the further outwardly disposed active temperature-control Peltier layer and the further inwardly disposed latent heat accumulator layer, and wherein the active temperature-control Peltier layer comprises Peltier elements.

2. The transport container according to claim 1, wherein at least two of the superimposed layers are in heat-conducting connection with one another.

3. The transport container according to claim 2, wherein the superimposed layers in heat-conducting connection are in full-surface contact with one another.

4. The transport container according to claim 1, wherein the latent heat accumulator layer, the heat insulation layer, and optionally the active temperature-control Peltier layer, each enclose the interior completely.

5. The transport container according to claim 1, wherein the transport container is designed as a rectangular parallelepiped structure, the enclosure comprises six walls, each wall comprises at least three layers, and each wall comprises at least the latent heat accumulator layer, the heat insulation layer and the active temperature-control Peltier layer.

6. The transport container according to claim 5, wherein one of the six walls comprises a door.

7. The transport container according to claim 1, wherein the active temperature-control layer is configured for converting electric energy into heat to be released or absorbed.

8. The transport container according to claim 1, wherein in the enclosure an energy distribution layer comprising a heat-conductive material is arranged within the energy distribution layer for uniformly distributing thermal energy acting on the container from outside, and wherein said energy distribution layer is optionally disposed further outside than the latent heat accumulator layer.

9. The transport container according to claim 8, wherein the energy distribution layer has a thermal conductivity $\lambda$ wherein $\lambda$ is greater than 100 W/(m·K).

10. The transport container according to claim 9, wherein the energy distribution layer has a thermal conductivity $\lambda$ wherein $\lambda$ is greater than 200 W/(m·K).

11. The transport container according to claim 1, wherein the enclosure further comprises an energy distribution layer disposed on either side of the latent heat accumulation layer, wherein each energy distribution layer comprises a heat-conductive material arranged within the energy distribution layer for uniformly distributing thermal energy acting on the container from outside.

12. The transport container according to claim 11, wherein the energy distribution layer has a thermal conductivity $\lambda$ wherein $\lambda$ is greater than 100 W/(m·K).

13. The transport container according to claim 12, wherein the energy distribution layer has a thermal conductivity $\lambda$ wherein $\lambda$ is greater than 200 W/(m·K).

14. The transport container according to claim 1, wherein the transport container is an ISO container or an airfreight container.

15. A transport container for transporting temperature-sensitive transport goods comprising an interior for receiving the transport goods, and an enclosure enclosing the interior, said transport container comprising a heat insulation layer, and at least one latent heat accumulator layer and at least one active temperature-control Peltier layer are provided for controlling the temperature in the interior, wherein the enclosure comprises a multilayer structure comprising an inwardly disposed layer comprising the at least one latent heat accumulator layer, the heat insulation layer, and an outwardly disposed layer comprising the at least one active temperature-control Peltier layer, which are configured as mutually separate, successively superimposed layers, wherein the heat insulation layer is disposed between the further inwardly disposed latent heat accumulator layer and the further outwardly disposed active temperature-control Peltier layer comprising Peltier elements.

16. The transport container according to claim 15, wherein the transport container is an ISO container or an airfreight container.

17. The transport container according to claim 16, wherein the transport container is an ISO container and comprises a rectangular parallelepiped structure, the enclosure comprises six walls, each wall comprises at least three layers, and each wall comprises at least the latent heat accumulator layer, the heat insulation layer and the active temperature-control Peltier layer, wherein the latent heat accumulator layer, the heat insulation layer, and optionally the active temperature-control Peltier layer, each enclose the interior completely, and wherein one of the six walls comprises a door.

18. The transport container according to claim 15, wherein the energy distribution layer has a thermal conductivity $\lambda$ wherein $\lambda$ is greater than 100 W/(m·K).

19. The transport container according to claim 18, wherein the energy distribution layer has a thermal conductivity $\lambda$ wherein $\lambda$ is greater than 200 W/(m·K).

* * * * *